US008210036B2

(12) United States Patent
Bekkeheien

(10) Patent No.: US 8,210,036 B2
(45) Date of Patent: Jul. 3, 2012

(54) DEVICES AND METHODS FOR FORMATION TESTING BY MEASURING PRESSURE IN AN ISOLATED VARIABLE VOLUME

(75) Inventor: Kjetil Bekkeheien, Røyneberg (NO)

(73) Assignee: Statoilhydro ASA, Royneberg (NO)

( * ) Notice: Subject to any disclaimer, the term of this patent is extended or adjusted under 35 U.S.C. 154(b) by 232 days.

(21) Appl. No.: 12/667,756

(22) PCT Filed: Jul. 2, 2008

(86) PCT No.: PCT/NO2008/000251

§ 371 (c)(1),
(2), (4) Date: Mar. 9, 2010

(87) PCT Pub. No.: WO2009/008731

PCT Pub. Date: Jan. 15, 2009

(65) Prior Publication Data

US 2010/0186495 A1 Jul. 29, 2010

(30) Foreign Application Priority Data

Jul. 6, 2007 (NO) ..... 20073508

(51) Int. Cl.
*E21B 47/06* (2006.01)

(52) U.S. Cl. ..... 73/152.51; 166/250.07

(58) Field of Classification Search ..... 73/152.22, 73/152.38, 152.51–152.53; 166/233, 250.07; 175/50

See application file for complete search history.

(56) References Cited

U.S. PATENT DOCUMENTS

| | | | | |
|---|---|---|---|---|
| 3,746,097 | A * | 7/1973 | Mott | 166/374 |
| 4,453,595 | A | 6/1984 | Lagus et al. | |
| 4,570,480 | A | 2/1986 | Fontenot et al. | |
| 5,115,871 | A | 5/1992 | McCann et al. | |
| 5,555,945 | A | 9/1996 | Schultz et al. | |
| 7,270,185 | B2 * | 9/2007 | Fontana et al. | 166/358 |
| 2003/0066650 | A1 * | 4/2003 | Fontana et al. | 166/358 |
| 2006/0065402 | A9 * | 3/2006 | Fontana et al. | 166/358 |

OTHER PUBLICATIONS

International Search Report issued Oct. 3, 2008 in International (PCT) Application No. PCT/NO08/00251.

Patent Cooperation Treaty (PCT) Written Opinion of the International Authority issued Oct. 3, 2008 in International (PCT) Application No. PCT/NO08/00251.

* cited by examiner

*Primary Examiner* — John Fitzgerald

(74) *Attorney, Agent, or Firm* — Wenderoth, Lind & Ponack, LLP

(57) ABSTRACT

A device (1) for formation testing while drilling. The device includes a drill string (2) with a packer (3) arranged on the drill-string (2) above a drilling-bit (7). The packer can be expanded and thereby isolate a lower open part (6) of a well-bore, distinguished in that the packer is fastened sealingly but slideably over a distance (4) of the well-bore, such that the drill-string can be moved up and down, with or without rotation, within the distance while the packer remains stationary due to being expanded in the well-bore. Also, the device includes at least one pressure transmitter for measuring and transferring in real-time to the surface measured pressure in the isolated lower open part of the well-bore. Methods for formation testing utilizing the device and a device for formation testing of a production well.

14 Claims, 2 Drawing Sheets

DEVICES AND METHODS FOR FORMATION TESTING BY MEASURING PRESSURE IN AN ISOLATED VARIABLE VOLUME

BACKGROUND OF THE INVENTION

1. Technical Field of the Invention

The present invention relates to formation testing, particularly related to drilling wells in hydrocarbon-containing reservoirs for exploration, delineation, production and injection. More specifically, the present invention relates to a device for formation testing when drilling, a method for determination of the fracturing pressure in a lower isolated open part of a well-bore, a method for determination of pore pressure in a lower isolated open part of a well-bore, a method for determination of formation properties in a lower isolated open part of a well-bore and a device for formation testing of a production well.

2. Description of the Related Art

When developing a hydrocarbon-containing field, a number of tasks should be solved as good as possible. Delineating the deposit and placing surface installations and wells, are some of the tasks to solve. Determining the well design, drilling program, production program and further development of the field after a while, are essential tasks.

While drilling, the pressure in the open part of a well can, in general, be held between the pore pressure and the fracturing pressure. When developing long wells, wells of low flow cross section and wells in depleted formations, it can be very challenging to find a functional solution for the casing program, drilling program and further development of the field. This is mainly because the available operational window is very narrow and additionally the knowledge about rock mechanics of the well-bore and possible formations for penetration often are insufficient. For the above-mentioned objectives determining the stress condition of the underground is essential. The stress condition and pressure change as the reservoir is produced. Maintaining pressure and stress condition can be achieved by injecting water and/or gas into the reservoir. A rock mechanical model including data from the whole development and service life of the field, and with frequent updates, is essential to achieve optimal development and production. Data of high quality is crucial for establishing and developing the model. Pore pressure, stress condition, fracturing pressure, temperature, geological weaknesses, information from underground samples, seismic and electromagnetic data are some of the parameters and measurements that are used for developing and updating the rock mechanical model.

A plurality of equipment and methods exist for measuring stress, pore pressure and flow potential in and through underground formations. Pressure build-up in an isolated section of an open part of a well-bore is often used for determining fracturing pressure. Reduction of pressure in an isolated section in an open part of a well-bore is often used to determine pore pressure and stresses in the formation. Likewise the formation properties in an isolated section of an open part of a well-bore can be determined by pumping in fluid and measuring pressure and back-flow over time from the formation. Further, equipment inter alia based on measuring resistivity and propagation and reflexes of acoustic waves, for the determination of occurrence and orientation of cracks, also exists.

In U.S. Pat. No. 6,148,912 formation evaluation is described during drilling, whereby pressure measurements are undertaken in a zone isolated by the use of packers on the drill string. In U.S. Pat. No. 4,453,595, a method is described for determining the fracturing pressure in an isolated lower part of a well-bore, whereby a controlled pressure increase exceeding a nominal pressure is generated with a separate cylinder/piston device providing controlled volume variation of the isolated lower well-bore chamber.

A demand exists for a device and methods simplifying the determination of formation properties in the underground in relation to drilling, particularly at and in front of a drilling bit, and particularly so that said properties can be determined without first drilling through the formation. There is a particular demand for determining fracturing pressure in a lower open part of a well-bore without significant risk of damaging the formation permanently by fracturing uncontrolled in a way lowering the fracturing pressure for subsequent drilling. There is a particular demand for a device and methods that are simple to use and that are flexible with respect to determining the fracturing pressure, closure pressure of the cracks (least horizontal stress), pore pressure and further formation properties quickly and effectively, without significant risk for damaging the underground formation and without significant risk for health, environment and security. There is a demand for a device that easily can be adapted to measure over smaller or larger isolated test zones. There is a particular demand for a device and methods for determining the formation properties, which also makes it simple to establish the integrity of the formation before subsequent drilling. Further, there is a demand for a device for formation testing in a production well.

SUMMARY OF THE INVENTION

The above-mentioned demands are met by the invention providing a device for formation testing while drilling. The invention includes a drill string with a packer arranged on the drill string above a drilling bit, the packer can be expanded and thereby isolate a lower open part of a well-bore, distinguished in that the packer is fastened sealingly, but slideably or glideably, on a distance of the drill string, such that the drill string can be brought up and down, with or without rotation, within said distance while the packer stands stationary expanded in the well-bore, and the device comprises at least one pressure transmitter for measuring and transferring in real-time to the surface the measured pressure in the isolated lower open part of the well-bore.

With the device according to the invention the drill-string can function as a piston rod that under very good control is used to increase or lower the volume in the lower isolated open part of the well-bore, while the pressure in the lower isolated open part is measured and transferred in real-time to the surface. The device preferably also comprises a down-hole micro pump, arranged to pump fluid in or out of the isolated open part of the well-bore. Thereby pressure can be increased by bringing the drill-string down, pumping in mud through the drill-string, and by pumping in fluid into the lower isolated part of the well-bore by use of the down-hole micro pump. The pressure can be lowered in the lower isolated open part of the well-bore by bringing the drill-string up and/or pumping out fluid with a micro pump. In the drill-string a check valve or similar is preferably arranged to hinder fluid from coming out of the drill-string when the drill-string is brought up and when the formation is fractured in a controlled way and the fracturing pressure is determined. The packer is preferably protected as retracted, by use of a protecting structure over and below, which structures also can function as down-hole choke valves. The closure pressure of the crack can be determined without bleeding back over said structures, as the drill-string preferably can be brought up to thereby reduced pressure in the lower isolated open part of the wellbore to below the closure pressure of the crack, which is often termed the lowest horizontal stress. A number of sensors, transmitters and telemetry are preferably arranged, with the device and drill-string for measuring different parameters, such as pressure, differential pressure, temperature, flow rate, composition, extent and geometry of fractures, sonic parameters in the surrounding formation and other known types of measuring equipment, preferably with real-time transferring to the surface for all measurements.

With the invention also a method is provided, for determining fracturing pressure in a lower isolated open part of a well-bore, by using the device according to the invention, distinguished by increasing pressure in a controlled way by bringing down the drill-string within an available slideable distance, optionally by repeated lifting of the drill-string, pumping in of fluid through the drill-string to previously achieved pressure and then further lowering of the drill-string for a further pressure increase, to observe non-linearity in a curve of measured pressure values as a function of volume reduction or drill-string movement in a lower isolated open part of the well-bore, as the point of non-linearity indicates beginning fracturing in the surrounding formation. The volume of the lower open isolated part of the well-bore is sufficiently small to obtain a linear relation between pressure increase and reduction of said volume, such that the beginning of fracturing can be observed as a deviation from linearity. The volume is sufficiently small and the control of the pressure increase is sufficiently good, to have a very small risk for deteriorating the formation permanently before further drilling. A pill of particles (for example graphite and potassium carbonate) for rehabilitation of the well-bore and recovering the integrity is preferably placed beforehand in the lower isolated open part of the well-bore.

With the invention also a method is provided for determining pore pressure in the lower isolated open part of a well-bore, by use of the device according to the invention, distinguished by controlled lowering of the pressure by bringing up the drill-string within an available slideable distance, optionally by pumping out with a micro pump and/or repeated lowering of the drill-string, pumping out with micro pump to previously achieved pressure and then further bring up the drill-string for further pressure reduction, to observe non-linearity in a curve of measured pressure values as a function of volume increase or drill-string movement in the lower isolated open part of the well-bore, as a point of non-linearity indicates pore pressure and beginning in-flow from the surrounding formation.

The invention also provides a method for measuring formation properties in a lower isolated open part of a well-bore, by using the device according to the invention, distinguished by pumping in fluid in a controlled way in a fractured isolated open part of the well-bore, and measuring pressure and optionally other parameters as a function of time while fluid flows back to the lower isolated open part of the well-bore. Advantageously, the drill-string can be brought down and up within the available slideable distance, for pressure increase and pressure reduction in the lower isolated open part of the well-bore, respectively.

The invention also provides a device for formation testing of a production well, comprising a pipe structure with a packer arranged on the pipe structure above a lower end, which packer can be expanded and thereby isolate a lower part of the production well, distinguished in that the packer is fastened sealingly but slideably over a distance of the pipe structure, such that the pipe structure can be brought up and down within said distance while the packer stands expanded and stationary in the production well. The device comprises at least one pressure transmitter for measuring and transferring to the surface in real-time measured pressure in the isolated lower part of the production well. The device preferably comprises a valve in or close to the lower end of the pipe structure, controllable from the surface, for opening, closing and chocking the flow path through the pipe structure. The device advantageously also comprises a down-hole micro pump, adapted to pump fluid into or out from the isolated lower part of the production well, over or through the expanded packer.

The slideable distance on the device according to the invention can be adapted within wide limits, however the distance is preferably one stand (typically 27-29 m), which means the length of three joined drill pipes, so that the devices can be handled appropriately on a drilling deck with standard equipment.

BRIEF DESCRIPTION OF THE DRAWINGS

The present invention is illustrated with drawings of which.

DETAILED DESCRIPTION OF THE INVENTION

Figure 1:
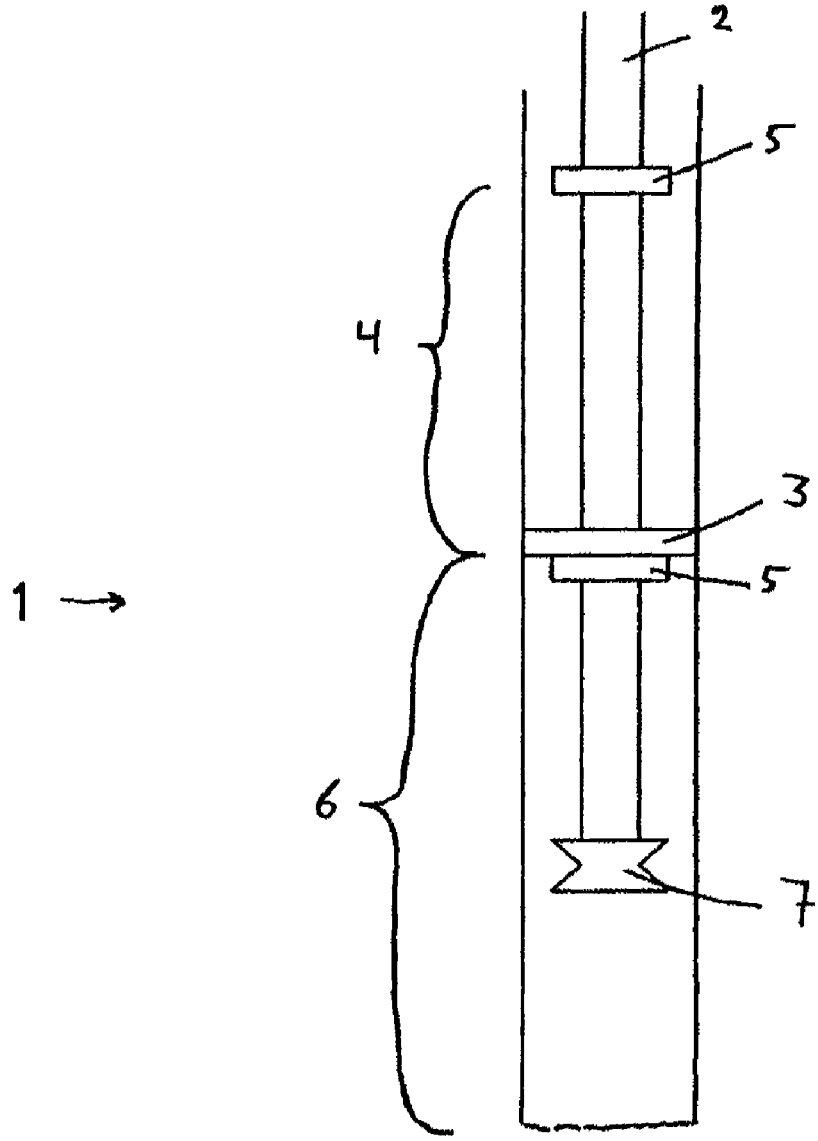
FIG. 1 illustrates a device according to the invention.

Reference is first made to FIG. 1 which illustrates a device 1 according to the invention. More specifically, a part of a drill-string 2 is illustrated, where an expandable packer 3 is arranged. The packer 3 is sealingly fastened to the drill-string 2, but can slide or glide over a distance 4 on the drill-string. The packer can be expanded, controlled from the surface, to seal between the drill-string and the well surface in the open part of a well-bore. When the packer is expanded, such that it stands stationary in against the wall of the well-bore, the drill-string can be brought up and down, with or without rotation, over the distance 4. The lower open part of a well-bore can thereby be isolated while the drill-string can be brought up a distance and thereby function as a piston rod, so that pressure can be increased or lowered in a controlled way in the volume in the open isolated part of the well-bore. Below the packer there is a lower open part 6 of the well-bore, which lower open part 6 is isolated by the packer 3 and drill-string 2. At the lower end of the drill string a drilling-bit 7 is arranged. The lower isolated open part of the well-bore 6 forms a pressure chamber, in which the pressure can be varied by lowering the drill-string or lifting the drill-string within the distance in which the packer can glide sealingly on the drill-string. Also, two stabilizers and chocking means 5 are illustrated, which limit the distance on the drill-string. The device preferably comprises sensors, in a number and of different types, and as a minimum at least one pressure transmitter for measuring and transferring to the surface in real-time the measured pressure in the lower isolated open part of the well-bore. Sensors and telemetry are not illustrated, but are of a general known type and design, and are included in the device according to demand. The expandable packer is of a commercially available type, and can be activated electrically, by a ball pumped down through the drill-string, by manipulating the drill-string or by other means. Relevant suppliers of the packers are Baker Oil Tools, Weatherford, Schlumberger and others. Optionally the packer is manufactured for this specific purpose.

The device can be modified to be used on a pipe body as well, in the form of a fixed pipe or part of a coiled tubing, for use in production wells for measuring formation properties in a lower isolated part of a production well. This constitutes an important embodiment of the invention, where the drill-string can be replaced by another type of pipe means. The device can also be used when drilling with a liner.

Figure 2:
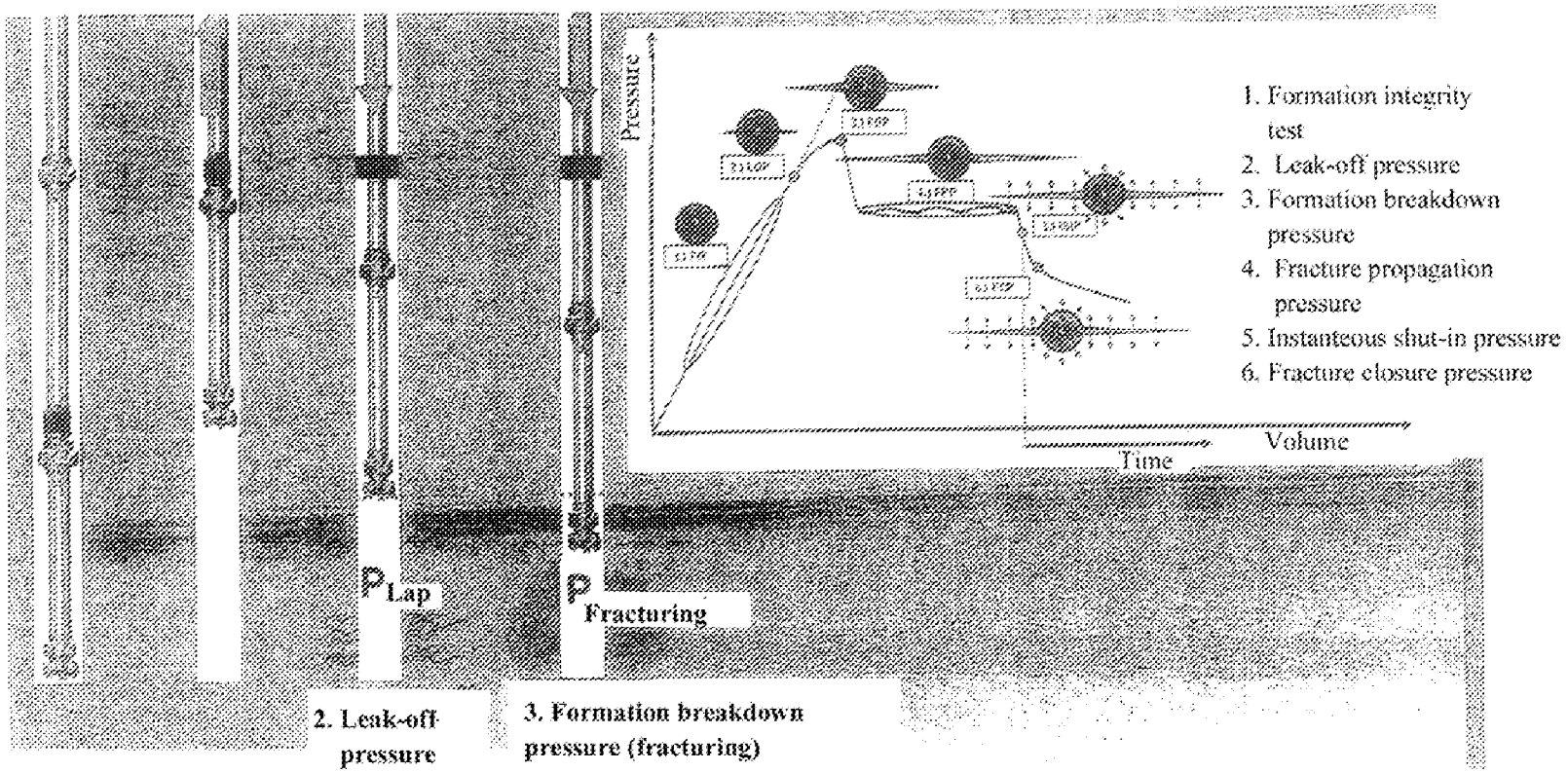
FIG. 2 illustrates a device according to the invention during operation.

Further reference is made to FIG. 2, which illustrates a fracturing test, optionally a pump-in/flow-back test, by using the device according to the invention. From left to right the illustrations are as follows: first drilling takes place to the bottom of the test interval, and a particle pill for reconstituting the well-bore surface after the test is positioned. Then the drill-string is retrieved to an identified packer set depth in accordance with the log from MWD (Measurement While Drilling). The packer element is expanded and the drill-string is prepared for piston movement. The pressure chamber, which means the lower isolated part of the well-bore, is set under increasing pressure by moving the drill-string downwards, until the beginning of fracturing. Beginning of fracturing is identified by the relation between pressure increase and displacement of the drill-string no longer being linear. Then an optional further pressure increase to fracture the formation further takes place, and optionally a full pumping in/back-flow test takes place (through a fixed check valve mounted in the drill-string just above the drilling-bit, not illustrated). FIG. 2 also indicates the curves that can be drafted, based on the measurement results and displacement of the drill-string. If fracturing does not take place by bringing the drill-string down the available distance, the drill-string can be brought all the way up said distance, fluid can be pumped into the isolated zone until the previous maximum pressure is achieved, and the drill-string can be brought down one more time to increase pressure/lower volume further. By combining pumping from the surface and repeated movements down and up of the drill-string, it is possible to "climb" upwards "the fracturing curve", up to the point where the straight line is deviated or the formation breaks down, and optionally further. This provides a controlled break-down of the formation without significant further growth of the cracks or fractures because of the limited driving force of the relatively small volume of the isolated zone compared to tests utilizing the full fluid column for pressure control. This also results in avoiding problems by compression, gel formation and tixotropic behavior of the drilling fluid. For determining the pore pressure and stresses in the lower isolated part of the well-bore, the pressure is lowered by piston movement of the drill-string, by bringing the drill-string up said distance, optionally in further steps by using a down-hole micro pump or a valve in the drill-string to lower pressure to previously achieved pressure, before further bringing the drill-string up, until non-linearity is observed, and optionally further.

With the device according to the invention measurements are typically made in front of the drilling-bit, as the drilling-bit is somewhat pulled back. This is important with respect to knowing exactly where the fracturing takes place, and ability to repair the fractures effectively before further drilling. Opposite other equipment it is not required to drill through the zone to be tested, which is because the lower part of the well-bore is tested, including the part below the bottom of the well-bore. This lowers the risk for loosing circulation or damaging the formation to a significant extent. It is low risk to jam the device, because the formation pressure is low only below the packer and drill-bit. The safety while drilling in strongly depleted reservoirs is significantly increased. With respect to measuring the formation pressure, the length of the measurement distance can easily be varied by varying the size of the pressure chamber or the isolated zone can be varied, and more packers can be used on one drill string, where each packer has a slideable distance on the drill string, such that the packers provide a different volume of the lower isolated zone. It is possible to seal long lower sections of the well-bore. The size of the isolated zone can also be varied by placing the device at different places in the well-bore. Preferably, means for differential pressure measurement and monitoring are arranged, to monitor against leakage over the packer, and to measure and monitor the pressure in the annulus below and above the packer. The concept of using the drill-string as a piston provides very accurate control over the pressure in the isolated zone. The pressure is adjusted by three methods, independently of each other or in combination, as follows: 1) Moving the drill-string up or down relative to the packer element as expanded, which lowers or increases the pressure in the isolated zone, respectively. 2) Through the drill-string, to pump drilling fluid down from the surface, which increases the pressure, or if the pressure in the isolated zone is higher than the pressure in the drill-string, to bleed out pressure through a check valve in the drill-string, the check valve preferably being placed a short distance above the drilling-bit. 3) To use a down-hole micro pump to pump fluid in or out of the isolated lower zone, with fluid communication over or through the packer.

The possibility of rotating the drilling-bit/drill-string within a distance of the size adjustable pressure chamber provides that the side cutters on the drilling-bit can remove filter cake on the inside of permeable formations (sand . . . ) to avoid the filter cake from hindering degrading of the formation. Vibrations can also easily be generated by use of drill pipe rotation. Rotate-ability also opens up for azimutal logging of fracture orientation, by undertaking measurements at different rotational orientations.

The effects of undertaking stress measurements with a very limited volume, compared to pressurizing the full well-bore, are very preferable. Improved well control is mentioned, because of maintained mud column over the pressure chamber (pressure differential over the packer element). Further, very low risk for uncontrolled fracture growth is mentioned, because of the small volume of the pressure chamber. Further, all the data will have improved accuracy because of the low volume, thereby avoiding errors because compressibility and stiffness in the system are avoided. Further, it is mentioned that effective repair of fractures can take place because their positions are known, and the fractures are small so that it is possible to place a particle pill dedicated for the purpose in the pressure chamber before undertaking the measurements. This results in a significantly reduced risk as the use of the device does not result in unfavorable effects for later operations, because the integrity of the test zone can be reestablished.

The packer can be in a retracted position during rotation of the drill-string during drilling, and thereby can be protected to avoid damage under rotation and tripping. Preferably, a check valve blocking the fluid way inside the drill-string when the drill-string is moved upwards is arranged (at pore pressure measurements) and by pressure increase/fracturing, whereby the pressure will be reduced when fluid flows into the fractures, which hinders flow downwards from the drill-pipe and into the pressurized volume. A valve of the float type, placed within the drill string, is standard for most bottom hole assemblies for drilling, and will isolate the pressurized chamber as pressurized from below, such as when undertaking stress measurements. The packer can be activated as previously mentioned, or for example by a sliding movement opening an activation gate, by use of a micro pump or by other means.

It is preferably possible to bleed back fluid volume pumped into the formation through a fixed down-hole choke valve, which for example can be a choke valve for bleeding in the device or a slightly too small stabilizer that can function as a fixed choke valve when the packers are retracted.

With the device according to the invention it is possible to "suck in formation fluid" into the well-bore and measure pore pressure of the formation either by retrieving the drill-string with the packer expanded, or at lower pore pressure by using a micro pump to reduce pressure within the pressurized lower volume to a certain level. Any combination of said means or steps is of course also possible.

The possibility to measure the actual pore pressure ahead of the drilling-bit and well-bore is extremely valuable with respect to drilling into reservoirs that are or can be seriously depleted. This is of special significance for drilling in depleted, high-pressure, high-temperature reservoirs, where the uncertainty is large with respect to pressure and stress conditions. With the devices and methods according to the invention, the integrity of a reservoir can be tested without first drilling through the reservoir. Further, the integrity of casing shoes can be tested before further drilling.

Preferably a sonic tool is arranged in the lower part of the well-bore that is isolated, to measure shear wave velocity as the pressure in the isolated volume changes. Such measurements and other possible measurements can provide very valuable information regarding the properties of the formation. Relations exist that based on measured parameters can be used to find further rock mechanical parameters. With the device according to the invention, it is possible to log closure of the fractures by using both measurements of pressure within the chamber and a resistivity tool to measure closure of fractures, which measurements support each other and result in data of high quality. In one embodiment a circulation port is preferably arranged so as to be able to circulate drilling fluid through the port when the packer element is or will be activated, which means circulation above the packer element (flow diverter).

Preferably an emergency release mechanism is arranged, making it possible to release the packer element if it for any reason should be jammed or fastened against the formation because of uncontrolled differential pressure or mechanical fastening.

The invention claimed is:

1. A device for formation testing while drilling, the device comprising a drill string with a packer arranged on the drill string above a drilling bit, the packer can be expanded and thereby isolate a lower open part of a wellbore, wherein the packer is fastened sealingly but slideably over a distance of the drill string, such that the drill string can be brought up and down, with or without rotation, within said distance while the packer stands stationary and expanded in the wellbore, and wherein the device comprises at least one pressure transmitter for measuring and transferring in real-time to the surface measured pressure in the isolated lower open part of the wellbore.

2. The device according to claim 1, wherein the drill string can function as a piston rod.

3. The device according to claim 1, wherein the device comprises a downhole micro pump, arranged to be able to pump fluid in or out of the isolated lower part of the well-bore, over the expanded packer.

4. The device according to claim 1, wherein an increase of pressure in the isolated part takes place by bringing the drill-string down and/or by pumping in fluid through the drill-string and/or by pumping in fluid with the micro pump.

5. The device according to claim 1, wherein lowering of the pressure in the isolated part of the well-bore takes place by bringing the drill-string up and/or pumping out fluid with the micro pump, or at high pressure in the lower isolated part of the wellbore, by controlled bleeding out the pressure through a valve arranged in the drill string.

6. The device according to claim 1, further comprising one or more of: sensors/transmitters for pressure, differential pressure, temperature, resistivity, and sonic wave velocity.

7. A method for determination of pore pressure in a lower isolated open part of a well-bore, by use of the device according to claim 1, the method including lowering the pressure in a controlled way by bringing up the drill-string within an available slideable distance, optionally by pumping out with a micro pump and/or repeated lowering of the drill-string, pumping out with a micro pump to previously achieved pressure and then further lifting of the drill-string for further pressure reduction, to observe non-linearity in a curve of measured pressure values as function of volume increase or drill-string movement in the lower isolated open part of the well-bore, as the point of non-linearity indicates pore pressure and beginning in-flow from the surrounding formation.

8. A method for determination of fracturing pressure in a lower isolated open part of a well-bore, by use of the device according to claim 1, the method including increasing the pressure in a controlled way by bringing the drill string down within an available slideable distance, optionally by repeated lifting of the drill-string, pumping in of fluid through the drill-string to previously achieved pressure and then further lowering of the drill-string for further pressure increase, to observe non-linearity in a curve of measured pressure values as function of volume reduction or drill-string movement in the lower isolated open part of the well-bore, as the point of non-linearity indicates beginning fracturing in the surrounding formation.

9. The method according to claim 8, wherein a pill of particles for rehabilitation of the well-bore's surface has been brought into the lower open part of the well-bore beforehand.

10. A method for determination of formation properties in a lower isolated open part of a well-bore, by using the device according to claim 1, the method including pumping in fluid in a controlled way in a fractured isolated lower open part of the well-bore, and measuring pressure and optionally other parameters as function of time while fluid flows back to said part of the well-bore.

11. The method according to claim 10, further including bringing the drill-string up an available slideable distance after fracturing, for controlled reduction of pressure and closure of fractures.

12. A device for formation testing of a production well, the device comprising a pipe means with a packer arranged on the pipe means above a lower end, which packer can be expanded and thereby isolate a lower part of the production well, wherein the packer is fastened sealingly but slidably on a distance of the pipe means, such that the pipe means can be brought up and down, within said distance, while the packer stands stationary and expanded in the production well, and the device comprises at least one pressure transmitter for measuring and transferring to the surface in real-time measured pressure in the isolated lower part of the production well.

13. The device according to claim 12, further comprising a valve in or close to the lower end of the pipe means, controllable from the surface.

14. The device according to claim 12, further comprising a down-hole micro pump, arranged to be able to pump fluid in or out of the isolated lower part of the production well, over the expanded packer.

* * * * *